US010253571B2

(12) United States Patent
Propes

(10) Patent No.: US 10,253,571 B2
(45) Date of Patent: Apr. 9, 2019

(54) ROTATIVELY MOUNTING CUTTERS ON A DRILL BIT

(71) Applicant: HALLIBURTON ENERGY SERVICES, INC, Houston, TX (US)

(72) Inventor: Christopher C. Propes, Montgomery, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 262 days.

(21) Appl. No.: 15/302,918

(22) PCT Filed: May 1, 2014

(86) PCT No.: PCT/US2014/036380
§ 371 (c)(1),
(2) Date: Oct. 7, 2016

(87) PCT Pub. No.: WO2015/167570
PCT Pub. Date: Nov. 5, 2015

(65) Prior Publication Data

US 2017/0030146 A1 Feb. 2, 2017

(51) Int. Cl.

| | |
|---|---|
| ***E21B 10/62*** | (2006.01) |
| ***E21B 17/042*** | (2006.01) |
| ***E21B 7/06*** | (2006.01) |
| ***E21B 17/046*** | (2006.01) |
| *E21B 10/08* | (2006.01) |

(52) U.S. Cl.
CPC ..... *E21B 10/62* (2013.01); *E21B 7/064* (2013.01); *E21B 17/042* (2013.01); *E21B 17/046* (2013.01); *E21B 10/08* (2013.01)

(58) Field of Classification Search
CPC ..... E21B 10/08; E21B 10/62; E21B 17/042; E21B 17/046; E21B 7/064
See application file for complete search history.

(56) References Cited

U.S. PATENT DOCUMENTS

| | | | |
|---|---|---|---|
| 4,222,446 | A | 9/1980 | Vasek |
| 4,553,615 | A | 11/1985 | Grainger |
| 4,751,972 | A | 6/1988 | Jones et al. |
| 6,283,234 | B1 | 9/2001 | Torbet |
| 6,932,172 | B2 | 8/2005 | Dvorachek |
| 7,703,559 | B2 | 4/2010 | Shen et al. |
| 7,762,359 | B1 | 7/2010 | Miess |
| 8,011,456 | B2 | 9/2011 | Sherwood, Jr. |

(Continued)

OTHER PUBLICATIONS

Korean International Property Office, International Search Report and Written Opinion, dated Mar. 9, 2016, 11 pages, Korea.

*Primary Examiner* — Caroline N Butcher

(57) ABSTRACT

A drill bit includes cutters rotatively mounted thereon. A bore is provided either directly in the drill bit or in a sleeve which is mounted on the drill bit. The bore includes a female screw thread, a circumferential groove, and one or more bearing surfaces. A cutter with a hardened table has a generally cylindrical body with a male screw thread, a circumferential groove, and one or more bearing surfaces. The cutter is engaged with the threads of the bore and then advanced until the male screw threads pass beyond the female screw threads. When the cutter is fully installed, the circumferential grooves provide relief for the screw threads so that the cutter can freely rotate within the bore.

18 Claims, 8 Drawing Sheets

(56) References Cited

U.S. PATENT DOCUMENTS

| | | | | |
|---|---|---|---|---|
| 8,286,735 | B1 | 10/2012 | Cooley et al. | |
| 2010/0314176 | A1* | 12/2010 | Zhang | E21B 10/573 175/383 |
| 2011/0031031 | A1 | 2/2011 | Vempati et al. | |
| 2012/0073881 | A1 | 3/2012 | Shen et al. | |
| 2013/0220707 | A1* | 8/2013 | Shen | E21B 10/5673 175/432 |

* cited by examiner

ROTATIVELY MOUNTING CUTTERS ON A DRILL BIT

CROSS-REFERENCE TO RELATED APPLICATION(S)

This application is a U.S. national stage patent application of International Patent Application No. PCT/US2014/036380, filed on May 1, 2014, the benefit of which is claimed and the disclosure of which is incorporated herein by reference in its entirety.

TECHNICAL FIELD

The present disclosure relates generally to oilfield equipment, and in particular to earth-boring drill bits used to drill a borehole for the recovery of oil, gas, or minerals. More particularly, the disclosure relates to the mounting of ultra-hard cutters to the body, blades, or roller cones of drill bits.

BACKGROUND

Oil and gas wells are typically drilled by a process of rotary drilling. An earth-boring drill bit is mounted on the lower end of a drill string. Weight is applied on the drill bit, and the bit is rotated by rotating the drill string at the surface, by actuation of a downhole motor, or both. The rotating drill bit includes cutters that engage the earthen formation to form a borehole. The bit can be guided to some extent using an optional directional drilling assembly located downhole in the drill string, to form the borehole along a predetermined path toward a target zone.

Many different types of drill bits and cutting structures for bits have been developed and found useful in drilling such boreholes. Two predominate types of rock bits are roller cone bits and fixed cutter bits. Both types of bits may include hardened elements that engage the earth to cut and liberate earthen materials such as rock. Roller cone bits include cutters that cut earth by gouging-scraping or chipping-crushing action. Fixed cutter bits include cutters that cut earth by shearing action.

While a drill bit is rotated, drilling fluid is pumped through the drill string and directed out of the drill bit. Drill bits typically include nozzles or fixed ports spaced about the bit face that serve to inject drilling fluid into the flow passageways between the several blades or amongst the roller cones. The flowing fluid performs several important functions. The fluid removes formation cuttings from the drill bit's cutting structure. Otherwise, accumulation of formation materials on the cutting structure may reduce or prevent the penetration of the cutting structure into the formation. In addition, the fluid removes formation materials cut from the bottom of the hole. Failure to remove formation materials from the bottom of the hole may result in subsequent passes by cutting structure to re-cut the same materials, thus reducing cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutters in order to prolong cutter life.

BRIEF DESCRIPTION OF THE DRAWINGS

Embodiments are described in detail hereinafter with reference to the accompanying figures, in which.

DETAILED DESCRIPTION

Figure 1:
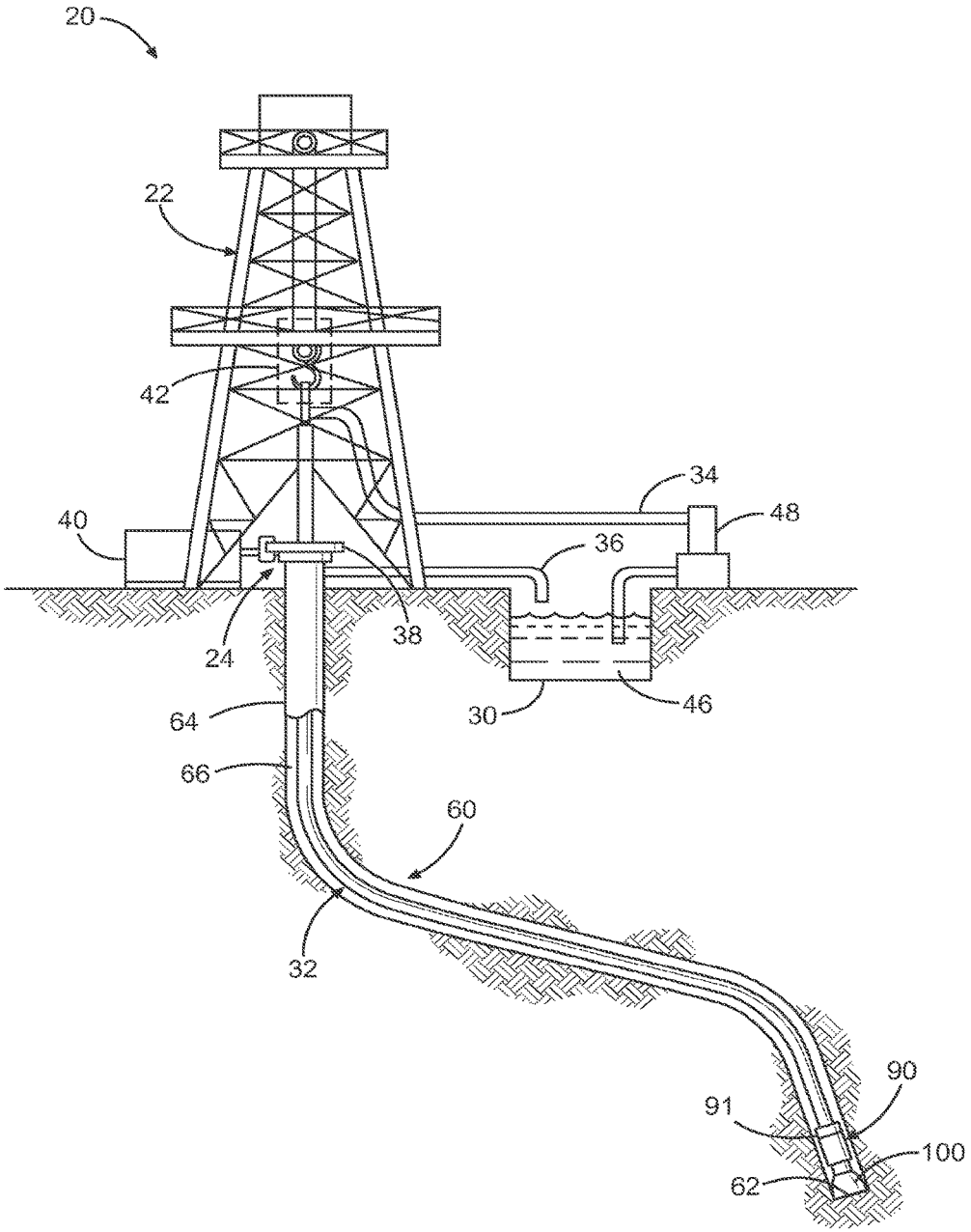
FIG. 1 is an elevation view in partial cross section of a drilling system according to an embodiment, showing a drilling rig, a drill string and the drill bit of FIG. 2 for drilling a bore in the earth.

FIG. 1 is an elevation view of one example of a drilling system 20 including a drill bit 100 and a drilling rig 22. Although drilling system 20 is illustrated with a drilling rig 22 that is land based, the, teachings of the present disclosure may also be used in association with marine and offshore drilling rigs, including offshore platforms, semi-submersible, drill ships and any other drilling system satisfactory for forming a wellbore extending through one or more downhole formations.

Drilling rig 22 may be located proximate well head 24 or may be spaced apart from well head 24, such as in offshore drilling systems. Drilling rig 22 also includes rotary table 38, rotary drive motor 40 and other equipment associated with rotation of drill string 32 within wellbore 60. Annulus 66 may be formed between the exterior of drill string 32 and the inside diameter of wellbore 60.

For some applications, drilling rig 22 may also include top drive motor or top drive unit 42. Blow out preventers (not expressly shown) and other equipment associated with drilling a wellbore may also be provided at well head 24. One or more pumps 48 may be used to pump drilling fluid 46 from reservoir 30 to one end of drill string 32 extending from well head 24. Conduit 34 may be used to supply drilling mud from pump 48 to the one end of drilling string 32 extending from well head 24. Conduit 36 may be used to return drilling fluid, formation cuttings and/or downhole debris from the bottom or end 62 of wellbore 60 to fluid reservoir or pit 30. Various types of pipes, tube and/or conduits may be used to form conduits 34 and 36.

Drill string 32 may extend from well head 24 and may be coupled with a supply of drilling fluid such as reservoir 30. The opposite end of drill string 32 may include bottom hole assembly 90 and rotary drill bit 100 disposed adjacent to end 62 of wellbore 60. Rotary drill bit 100 may include one or more fluid flow passageways with respective nozzles 20 (FIG. 2) disposed therein, as described in greater detail below. Various types of drilling fluids 46 may be pumped from reservoir 30 through pump 48 and conduit 34 to the end of drill string 32 extending from well head 24. The drilling fluid 46 may flow down through drill string 32 and exit from nozzles 16 (FIG. 2) formed in rotary drill bit 100.

At end 62 of wellbore 60, drilling fluid 46 may mix with formation cuttings and other downhole debris proximate drill bit 100. The drilling fluid will then flow upwardly through annulus 66 to return formation cuttings and other downhole debris to well head 24. Conduit 36 may return the drilling fluid to reservoir 30. Various types of screens, filters and/or centrifuges (not shown) may be provided to remove formation cuttings and other downhole debris prior to returning drilling fluid to pit 30.

Bottom hole assembly 90 may include various tools 91 that provide logging or measurement data and other information from the bottom of wellbore 60. Measurement data and other information may be communicated from end 62 of wellbore 60 through drill string 32 using known measurement while drilling techniques and converted to electrical signals at well surface 24, to, among other things, monitor the performance of drilling string 32, bottom hole assembly 90 and associated rotary drill bit 100.

Figure 2:
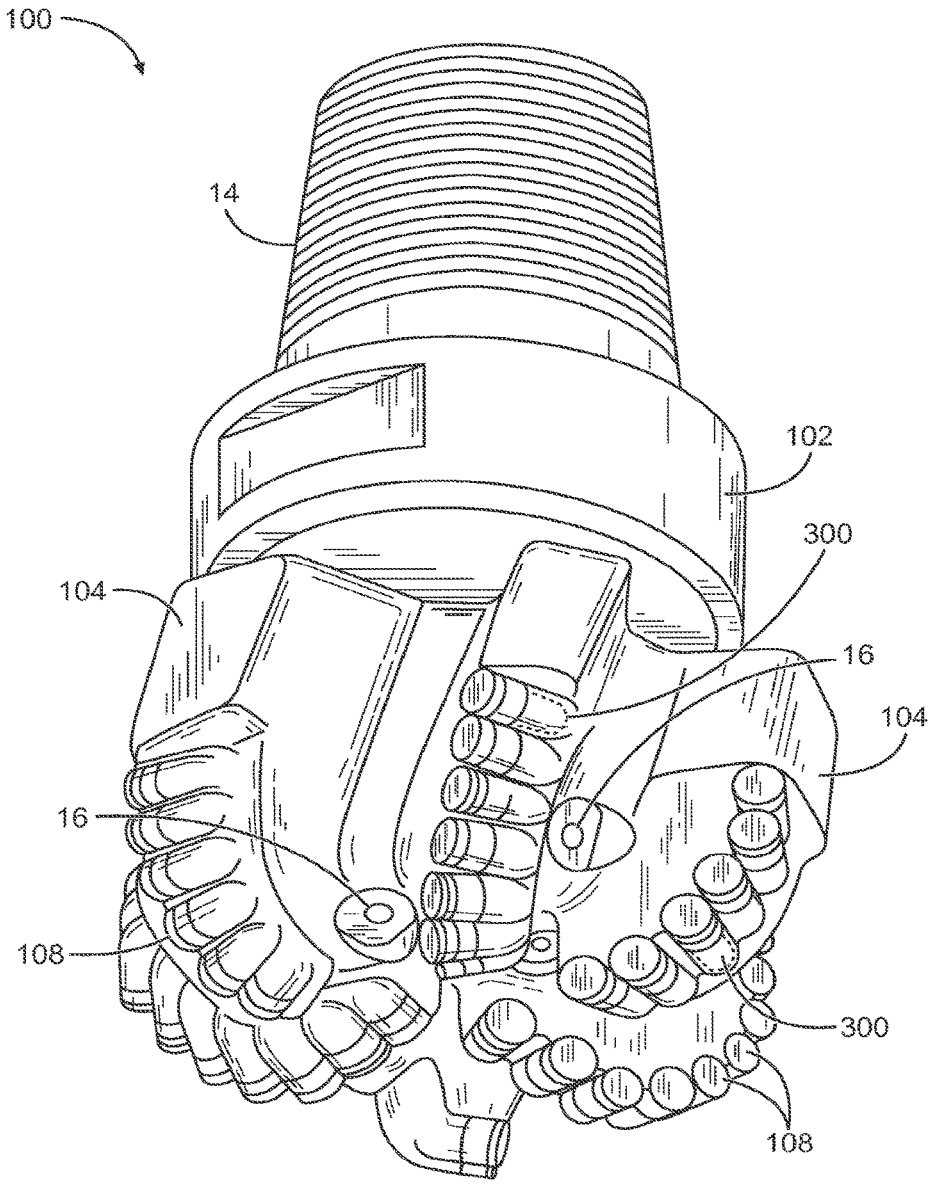
FIG. 2 is a perspective view of a fixed cutter drill bit according to an embodiment, showing a blade having at least one cutter rotatively mounted within a bore disposed within the blade.

FIG. 2 is a perspective view of one embodiment of drill bit 100. Drill bit 100 is a fixed cutter drill bit having a hollow bit body 102 that has an upper pin end 14 for threaded connection to a drill string 32 (shown in FIG. 1). Bit body 102 includes a plurality of blades 104 that extend from the lower end of drill bit 100. Each blade 104 forms a cutting surface of the bit 100. Although six blades 104 are shown, any suitable number of straight or curved blades may be provided.

Drill bit 100 may be manufactured using powder metallurgy techniques, which generally entail blending and mixing metal powders, compressing the metal powders into a bit-shaped matrix, and sintering the matrix under elevated temperatures to cause solid-state bonding of the powders. However, drill bit 100 may also be manufactured by casting, forging, machining, or another suitable manufacturing process, and the disclosure is not limited to a particular manufacturing process for the drill bit body.

Blades 104 may be angularly spaced about the bit face and project radially outward from the bit axis to define flow channels, sometimes referred to as junk slots, therebetween. Drill bit 100 may include one or more nozzles 16 for jetting drilling fluid to aid in formation cutting, tool cooling, lubrication, and debris removal. Nozzles 16 are fluidly connected within body 102 and receive drilling fluid via the drill string 32 (FIG. 1).

Each blade 104 carries a number of hard cutters 108. Cutters 108 are made of a material sufficiently hard to cut through earth formations, such as by scraping and/or shearing. Cutters 108 may be spaced apart on a blade 104 in a fixed, predetermined pattern, typically arrayed along the leading edges of each of several blades 104 so as to present a predetermined cutting profile to the earth formation. That is, each cutter 108 is positioned and oriented on bit 100 so that a portion of it, its cutting edge or wear surface, engages the earth formation as the bit is being rotated. Additionally, cutters 108 may be disposed so as to define a predetermined rake angle. The configuration or layout of cutters 108 on the blades 104 may vary widely, depending on a number of factors. One of these factors is the formation itself, as different cutter layouts cut the various strata with differing results and effectiveness.

According to one or more embodiments, at least one cutter 108 is rotatively mounted within a bore 300 located in bit body 102. Bore 300 is typically located in the leading edge of a blade 104, but it may be formed on bit body 102 wherever it is desirable to attach a cutter 108. When rotatively mounted, the portion of cutter 108 that is exposed to the formation at any given time continually changes as the cutter freely rotates, thereby providing an overall greater exposed cutter area and extended cutter wear.

Figure 3:
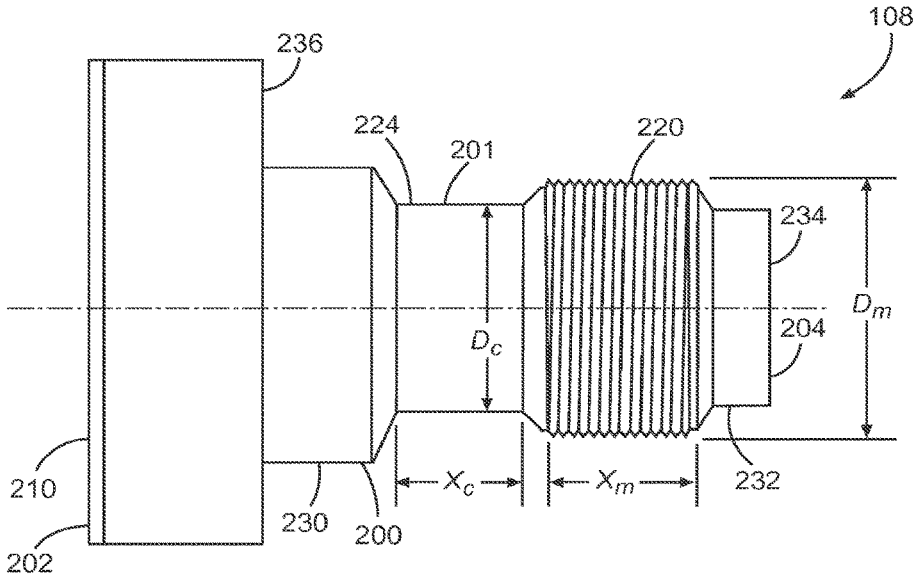
FIG. 3 is an elevation view of cutter for rotatively mounting within the drill bit of FIG. 2, showing a generally cylindrical body with a male screw thread formed thereon and a circumferential groove formed adjacent to the male screw thread.

FIG. 3 is an elevation of a cutter 108 according to some exemplary embodiments. Cutter 108 has an elongate and generally cylindrical body 200, which defines a shaft 201 extending between a face end 202 and a root end 204. Each cutter 108 may be manufactured as a discrete piece. While the disclosure is not limited to a particular material or manufacturing method for forming cutter 108, in one or more embodiments, body 200 may be formed of a cemented metal carbide, such as tungsten carbide, by sintering powdered metal carbide with a metal alloy binder.

In one or more embodiments, a hardened table 210 may be bonded or otherwise attached to body 200 at face end 202. Table 210 may be formed of an extremely hard superabrasive material such polycrystalline diamond compact (PCD), cubic boron nitride, thermally stable PDC (TSP), polycrystalline cubic boron nitride, or ultra-hard tungsten carbide (TC). Table 210 may be formed and bonded to body 200 using an ultra-high pressure, ultra-high temperature process. Although not illustrated, cutter 108 may also include transitional layers in which metal carbide and diamond are mixed with other elements for improving bonding and reducing stress between body 200 and table 210.

Shaft 201 of cutter 108 includes a male screw thread 220 defined along shaft 201. In some embodiments, male screw threads 220 may be defined on shaft 201 adjacent to or in proximity to root end 204. Male screw thread 220 defines a major diameter $D_m$ and extends for an axial length $x_m$. Shaft 201 of cutter 108 also includes a circumferential groove 224 formed therein located adjacent male screw thread 220 toward face end 202. Circumferential groove 224 defines a diameter $D_c$ and an axial length $x_c$.

Cutter 108 may include a circumferential radial bearing surface 230 axially located toward face end 202 from circumferential groove 224 and/or a circumferential radial bearing surface 232 axially located toward root end 204 from male screw thread 220. Cutter 108 may also include a thrust bearing surface 234 located at root end 204 and/or a thrust bearing surface 236 at a shoulder axially located toward face end 202 from circumferential groove 224.

Figure 4:
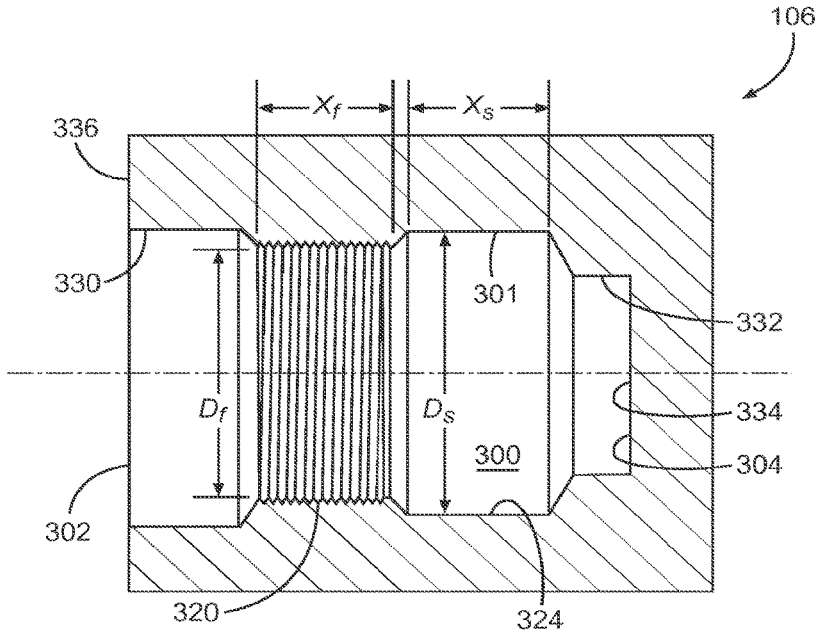
FIG. 4 is an axial cross section of a sleeve into which the cutter of FIG. 3 may be rotatively mounted according to an embodiment, showing a bore having a female screw thread formed therein and a circumferential groove formed adjacent to the female screw thread.

FIG. 4 is an axial cross section of a sleeve 106 according to an exemplary embodiment into which cutter 108 is rotatively mountable. Sleeve 106 defines an elongate and generally cylindrical bore 300 that has an inner surface 301, a face end 302, and a root end 304. Surface 301 of bore 300 includes female screw threads 320 defined along surface 301. In some embodiments, female screw threads 320 are defined adjacent to or in proximity to face end 302. Female screw threads 320 define a minor diameter $D_f$ and extends for an axial length $x_f$. Surface 301 of bore 300 also includes a circumferential groove 324 formed therealong and located adjacent female screw thread 320 toward root end 304. Circumferential groove 324 defines a diameter $D_s$ and an axial length $x_s$.

Bore 300 may include a circumferential radial bearing surface 330 axially located toward face end 302 from female screw thread 320 and/or a circumferential radial bearing surface 332 axially located toward root end 304 from circumferential groove 324. Bore 300 may also include a thrust bearing surface 334 located at root end 304 and/or a thrust bearing surface 336 at a shoulder axially located toward or at face end 302 from female screw thread 320. Shoulder 336 may be defined by the face end of sleeve 106 itself.

Figure 5:
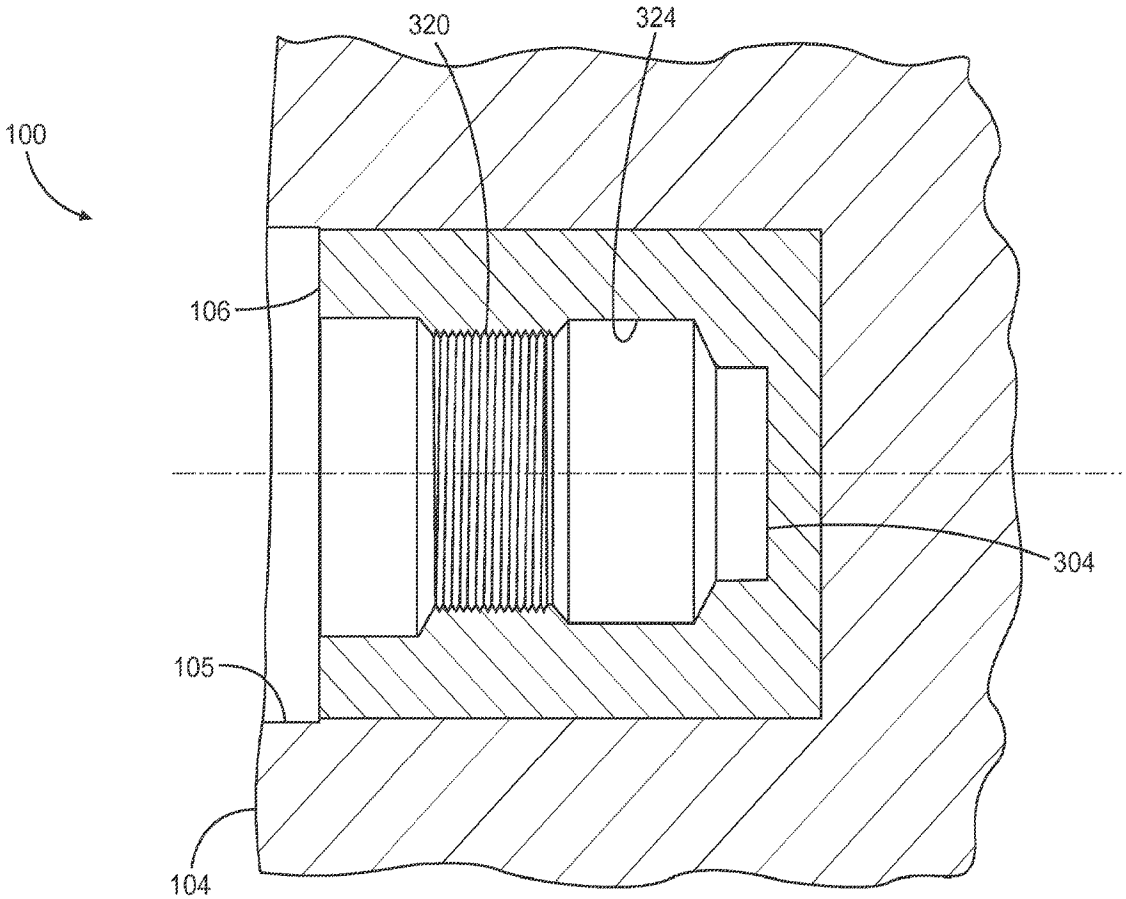
FIG. 5 is an axial cross section of the sleeve of FIG. 4 shown mounted within a pocket formed in a blade of the drill bit of FIG. 2 according to an embodiment.

As shown in FIG. 4, sleeve 106 may be manufactured as a discrete part and have a cylindrical exterior shape, for example. However, sleeve 106 may have other exterior shapes as appropriate. FIG. 5 is an axial cross section of sleeve 106 shown installed in a blade 104 of drill bit 100 (FIG. 2). Sleeves 106 may be initially mounted to drill bit 100 in one or more various processes: According to a first technique, drill bit 100 is formed to include pockets 105 into which sleeves 106 are received. In one or more embodiments, sleeves 106 may be press fit into the pockets 105 or inserted and brazed into place on drill bit 100. Although brazing and press-fitting are preferred methods of attachment, other techniques may be used, including cementing or hard facing. In one or more embodiments, a drill bit is manufactured using powdered metallurgy, which may be made, for instance, by filling a graphite mold with metallic particulate matter such as powdered tungsten, compacting, sintering, and then infiltrating the powdered metal matrix with a molten metal alloy. In these embodiments, sleeves 106 may be placed in the matrix before infiltration and then bonded in place by the infiltration process.

Figure 6:
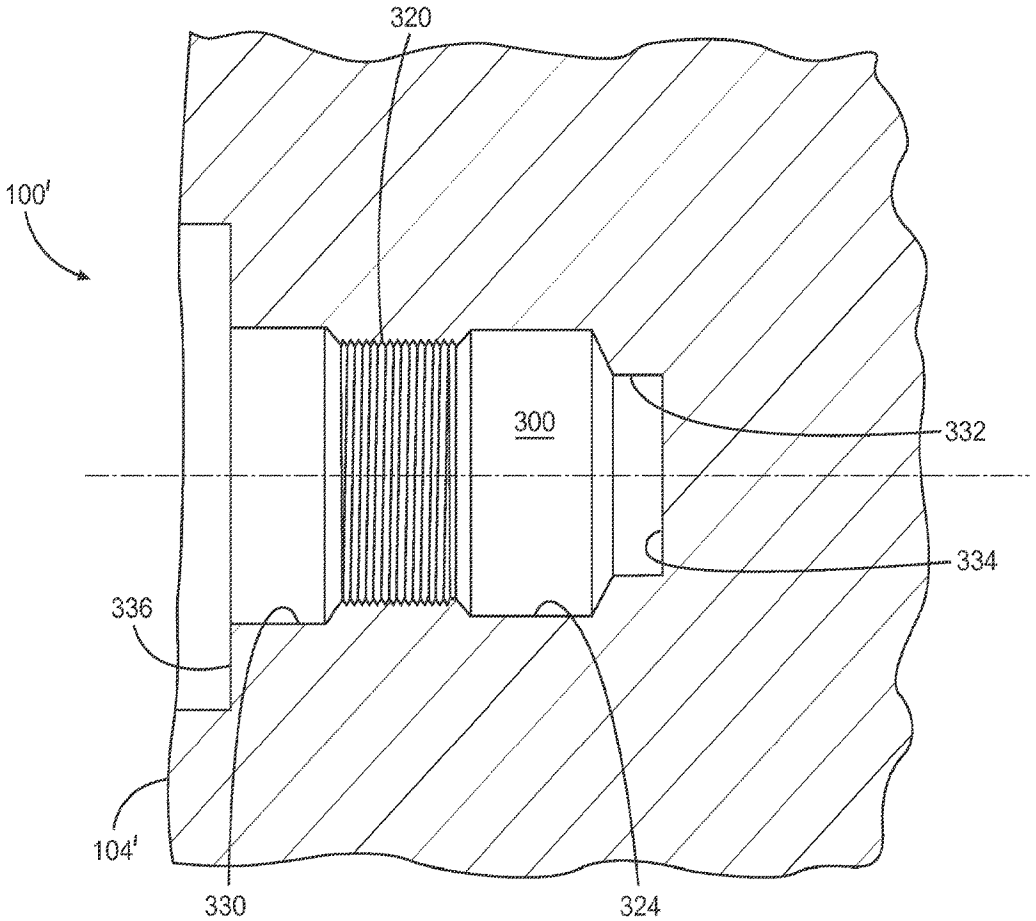
FIG. 6 is an axial cross section of a bore formed directly into a blade of the drill bit of FIG. 2 which the cutter of FIG. 3 may be rotatively mounted according to an embodiment, showing a female screw thread formed therein and a circumferential groove formed adjacent to the female screw thread.

FIG. 6 is a cross section of a blade 104' of a drill bit 100' according to an alternate embodiment, in which the generally cylindrical bore 300 of sleeve 106 (FIG. 4) is formed directly in blade 104'. Accordingly, discrete sleeves 106 are omitted in the embodiment of FIG. 6. Bore 300 is of blade 104' may have the same features and characteristics as bore 300 of sleeve 106, including female screw thread 320, circumferential groove 324, circumferential radial bearing surfaces 330, 332, and thrust bearing surfaces 334, 336. Such features may be molded or cast with the bit body, or they may be machined into the bit body after it has been formed. In the embodiment of FIG. 6, cutter 108 (FIG. 3) is rotatively mounted in bore 300 formed in blade 104' in same manner as described herein with respect to sleeve 106.

Figure 7:
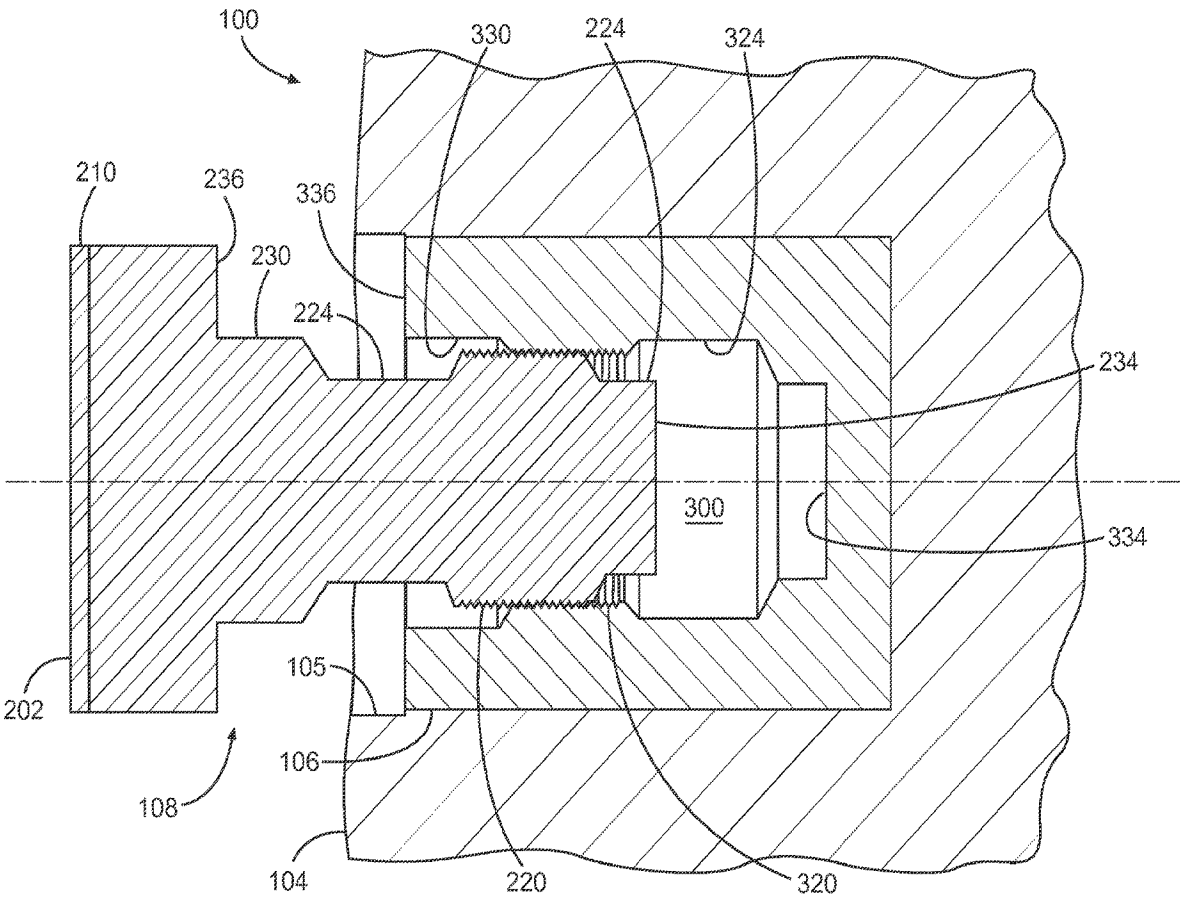
FIG. 7 is an axial cross section of the sleeve and blade of FIG. 5 shown with the cutter of FIG. 3 being threaded into the bore during installation of the cutter.

FIG. 7 is an axial cross section of sleeve 106, as it is being mounted in pocket 105 in blade 104. Cutter 108 is installed by screwing cutter 108 into bore 300. Male screw thread 220 is engaged and advanced into female screw thread 320 by turning cutter 108 in the direction of rotation of the screw thread, i.e. clockwise for a right-hand thread and counterclockwise for a left-hand thread. In this regard, in one or more embodiments, the screw threads may be right-handed threads, while in other embodiments, the screw threads may be left-handed threads. Cutter 108 may be characterized by a natural tendency to rotate either clockwise or counterclockwise when drill bit 100 is rotated in the wellbore during drilling operations, depending on the direction of drill bit rotation, the shape and orientation of blade 104, and the position and orientation, i.e., rake angle of cutter 108 on blade 104. The direction of male and female screw threads 220, 320 is preferably selected so that cutter 108 is inclined to screw inwardly during drilling operations to avoid the tendency of cutter 108 from unscrewing and backing out of bore 300.

Figure 8:
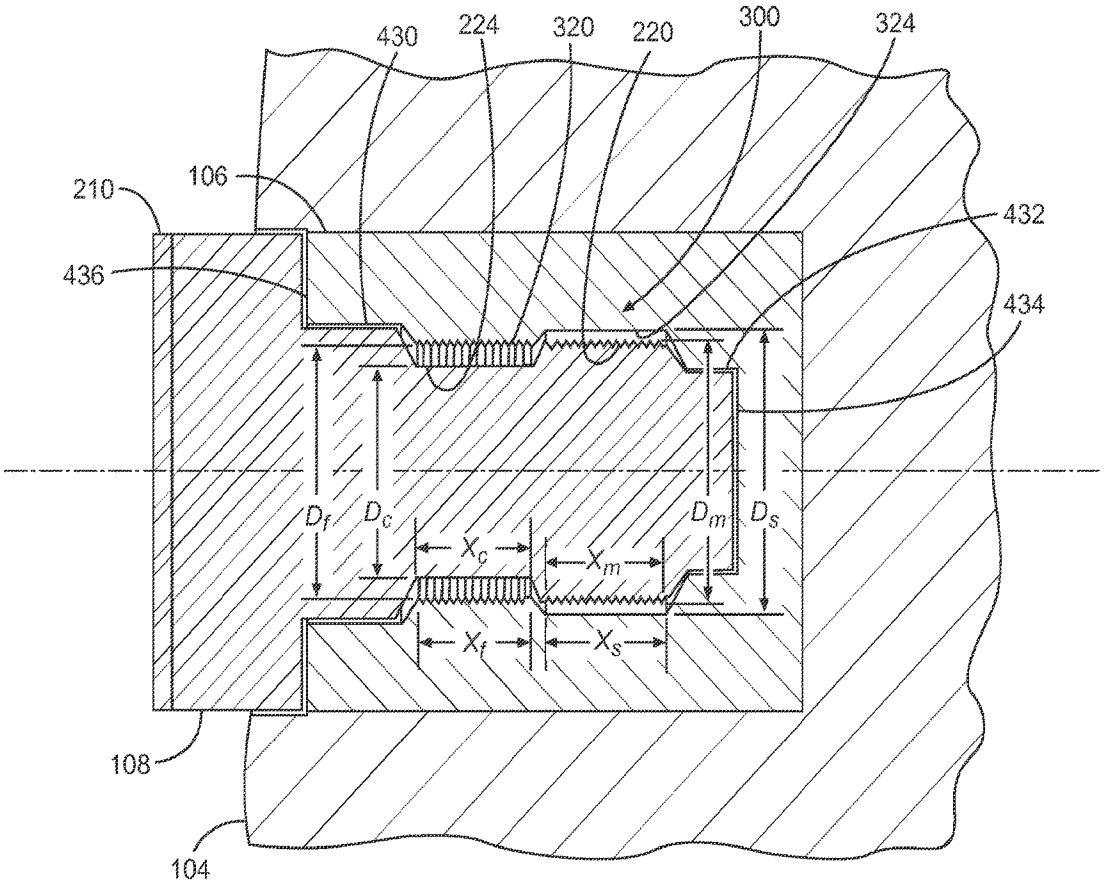
FIG. 8 is an axial cross section of the cutter, sleeve and blade of FIG. 7 shown with the cutter fully installed and rotatively captured within the bore.

FIG. 8 is an axial cross section of sleeve 106, mounted in pocket 105 in blade 104, with cutter 108 rotatively mounted in sleeve 106. Cutter 108 is advanced into bore 300 to such an extent that male screw thread 220 has disengaged female screw thread 320. Because the diameter $D_s$ and axial length $x_s$ of circumferential groove 324 is greater than the major diameter $D_m$ and axial length $x_m$, respectively, of male screw thread 220, because the diameter $D_c$ of circumferential groove 224 is less than the minor diameter $D_f$ of female screw thread 320, and because the axial length $x_c$ of circumferential groove 224 is greater than the axial length $x_f$ of female screw thread 320, cutter 108 may freely rotate within bore 300 of sleeve 106.

A first radial bearing 430 may be provided at and or defined by the interface of circumferential radial bearing surface 230 (FIG. 3) and circumferential radial bearing surface 330 (FIG. 4). A second radial bearing 432 may be provided at and or defined by the interface of circumferential radial bearing surface 232 (FIG. 3) and circumferential radial bearing surface 332 (FIG. 4). A first thrust bearing 434 may be provided at and or defined by the interface of thrust bearing surface 234 (FIG. 3) and thrust bearing surface 334 (FIG. 4). A second thrust bearing 436 may be provided at and or defined by the interface of thrust bearing surface 236 (FIG. 3) and thrust bearing surface 336 (FIG. 4).

Bearings 430, 432, 434, 436 may include various bearing materials, which may be layered on one or more of the individual bearing surfaces, for example. Bearings 430, 432, 434, 436 may also include lubricants and/or bearing elements, such as balls or rollers (not illustrated).

Although cutters 108 have generally been described as being mounted on the blades of a fixed blade drill bit, cutters 108 may be incorporated into any type of drill bit and mounted on any part of the drill bit, as desired. Thus, in one or more embodiments, at least one, and in some embodiments, a plurality of cutters 108 are rotatively mounted on the cone of a rotary cone drill bit (not shown).

Figure 9:
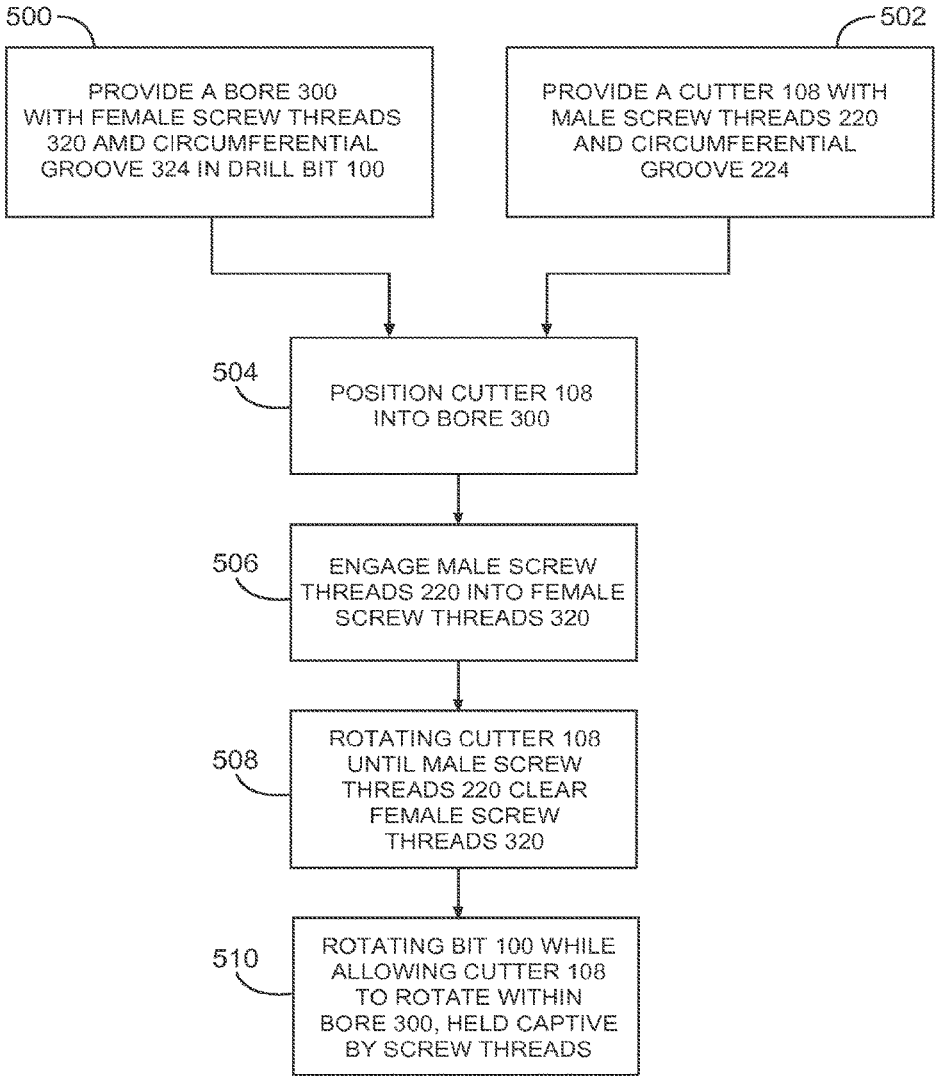
FIG. 9 is a flow chart outlining a method for rotatively mounting the cutter of FIG. 3 onto the drill bit of FIG. 2.

FIG. 9 is a flow chart that describes a method for rotatively mounting cutter 108 on drill bit 100 according to an embodiment. At step 500, bore 300 is provided in drill bit 100, which may be formed directly in drill bit 100 as shown in FIG. 6 or may be formed in sleeve 106 which is then mounted in drill bit 100 as shown in FIG. 5. Bore 300 includes female screw thread 320 and circumferential groove 324. At step 502, which may occur independently of step 500, cutter 108 is provided. Cutter 108 includes male screw thread 220 and circumferential groove 224.

At step 504, cutter 108 is positioned into bore, and at step 506, male screw thread 220 is engaged with female screw thread 320. At step 508, cutter is rotated so that it is fully advanced into bore 300 to a point where circumferential groove 324 provides relief and allows free relative rotation of male screw thread 220 and circumferential groove 224 provides relief and allows free relative rotation of female screw thread 320. Screw threads 220, 320 retain cutter in bore 300. At step 510, drill bit 100 is rotated within the wellbore. Cutter 108 freely rotates within bore 300 during such drilling operations.

In summary, a cutter for a drill bit, a drilling system, and method for drilling a wellbore have been described. Embodiments of the cutter may have a generally cylindrical body defining a shaft extending between a face end and a root end, a hardened table disposed at the face end, a male screw thread formed along the shaft, and a circumferential groove formed along the shaft between the face end and the male screw thread. Embodiments of the drilling system may generally have a drill bit having a drill bit body; a bore formed within the drill bit body, the bore having a generally cylindrical inner surface, a face end facing outwardly from the drill bit body, a root end, a female screw thread formed along the inner surface, and a circumferential groove formed along the inner surface between the root end of the bore and the female screw thread; a cutter body rotatively received within the bore, the cutter body having a generally cylindrical shaft, a face end, a root end, a male screw thread formed along the shaft, and a circumferential groove formed along the shaft between the face end and the male screw thread; and a hardened table disposed at the face end of the cutter body. Embodiments of the method may generally include providing a drill bit; providing a bore in the drill bit, the bore having a generally cylindrical inner surface, a face end facing outwardly from the drill bit, a root end, a female screw thread formed along the inner surface, and a circumferential groove formed along the inner surface between the root end of the bore and the female screw thread; providing a cutter having a generally cylindrical shaft, a face end, a root end, a male screw thread formed along the shaft, and a circumferential groove formed along the shaft between the face end of the cutter and the male screw thread; positioning the root end of the cutter into the face end of the bore; engaging the male screw thread into the female screw thread; rotating the cutter in a first direction with respect to the bore so that the male screw thread advances past the female screw thread into the circumferential groove of the bore; and rotating the drill bit within the wellbore; whereby the cutter is rotatively captured within the bore.

Any of the foregoing embodiments may include any one of the following elements or characteristics, alone or in combination with each other: At least one radial bearing surface circumferentially formed along the shaft at an axial location selected from the group consisting of a first location between the face end and the circumferential groove, and a second location between the root end and the male screw thread; at least one thrust bearing surface formed on the body at a location selected from the group consisting of the root end and a shoulder formed along the shaft between the face end and the circumferential groove; a sleeve having a generally cylindrical bore formed therein, the sleeve having an inner surface, a face end and a root end; a female screw thread formed along the bore and dimensioned so as to mate with the male screw thread; a circumferential groove formed along the inner surface between the root end of the sleeve and the female screw thread, the circumferential groove of the sleeve characterized by a diameter greater than a major diameter of the male screw thread; the circumferential groove of the sleeve is characterized by an axial length greater than an axial length of the male screw thread; the circumferential groove of the body is characterized by a diameter less than a minor diameter of the female screw thread; the circumferential groove of the body is characterized by an axial length greater than an axial length of the female screw thread; at least one radial bearing surface circumferentially formed along the inner surface of the sleeve at an axial location selected from the group consisting of a first location between the root end of the sleeve and the circumferential groove of the sleeve, and a second location between the face end of the sleeve and the female screw thread; at least one thrust bearing surface formed on the sleeve at a location selected from the group consisting of the root end and a shoulder formed on the sleeve toward the face end from the female screw thread; the male screw thread is dimensioned so as to mate with the female screw thread; the circumferential groove of the bore is characterized by a diameter greater than a major diameter of the male screw thread; the circumferential groove of the cutter body is characterized by a diameter less than a minor diameter of the female screw thread; the circumferential groove of the bore is characterized by an axial length greater than an axial length of the male screw thread; the circumferential groove of the cutter body is characterized by an axial length greater than an axial length of the female screw thread; at least one radial bearing formed between the bore and the cutter body; at least one thrust bearing formed between the bore and the cutter body; the at least one radial bearing is disposed at an axial location from the group consisting of a first location toward the face end of the bore from the female screw thread and a second location toward the root end of the cutter body from the male screw thread; the at least one thrust bearing is disposed at an axial location selected from the group consisting of the root end of the cutter body and a shoulder formed toward the face end of the bore from the female screw thread; a sleeve, the bore being formed in the sleeve; a pocket formed in the drill bit body, the sleeve being disposed within the pocket; a drill string coupled to the drill bit so as to rotate the drill bit within the wellbore; providing a sleeve; forming the bore in the sleeve; providing a pocket in the drill bit; disposing the sleeve within the pocket; orienting the bore in the drill bit so that the face end of the cutter defines a rake angle; urging the cutter to rotate in the first direction within the bore by the rake angle while the drill bit is rotating within the wellbore; coupling the drill bit to a drill string; rotating the drill bit within the wellbore by the drill string; providing a hardened table at the face end of the cutter; retaining by the male screw thread and the female screw thread the cutter within the bore; providing relief for free relative rotation by the circumferential groove of the bore for the male screw thread; and providing relief for free relative rotation by the circumferential groove of the cutter for the female screw thread.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A cutter for a drill bit for drilling a wellbore in an earthen formation comprising:

a generally cylindrical body defining a shaft extending between a face end and a root end;

a hardened table disposed at said face end;

a male screw thread formed along the shaft;

a circumferential groove formed along the shaft between said face end and said male screw thread;

a sleeve having a generally cylindrical bore formed therein, the sleeve having an inner surface, a face end and a root end;

a female screw thread formed along the bore and dimensioned so as to mate with said male screw thread; and a circumferential groove formed along the inner surface between said root end of said sleeve and said female screw thread, said circumferential groove of said sleeve characterized by a diameter greater than a major diameter of said male screw thread.

2. The cutter of claim 1 further comprising:

at least one radial bearing surface circumferentially formed along the shaft at an axial location selected from the group consisting of a first location between said face end and said circumferential groove, and a second location between said root end and said male screw thread.

3. The cutter of claim 1 further comprising:

at least one thrust bearing surface formed on said body at a location selected from the group consisting of said root end and a shoulder formed along said shaft between said face end and said circumferential groove.

4. The cutter of claim 1 wherein:

said circumferential groove of said sleeve is characterized by an axial length greater than an axial length of said male screw thread.

5. The cutter of claim 1 wherein:

said circumferential groove of said body is characterized by a diameter less than a minor diameter of said female screw thread.

6. The cutter of claim 1 wherein:

said circumferential groove of said body is characterized by an axial length greater than an axial length of said female screw thread.

7. The cutter of claim 1 further comprising:

at least one radial bearing surface circumferentially formed along the inner surface of said sleeve at an axial location selected from the group consisting of a first location between said root end of said sleeve and said circumferential groove of said sleeve, and a second location between said face end of said sleeve and said female screw thread.

8. The cutter of claim 1 further comprising:

at least one thrust bearing surface formed on said sleeve at a location selected from the group consisting of said root end and a shoulder formed on said sleeve toward said face end from said female screw thread.

9. A drilling system for drilling a wellbore in an earthen formation comprising:

a drill bit having a drill bit body;

a bore provided within said drill bit body, said bore having a generally cylindrical inner surface, a face end facing outwardly from the drill bit body, a root end, a female screw thread formed along the inner surface, and a circumferential groove formed along the inner surface between said root end of said bore and said female screw thread;

a cutter body rotatively received within said bore, said cutter body having a generally cylindrical shaft, a face end, a root end, a male screw thread formed along the shaft, and a circumferential groove formed along the shaft between said face end and said male screw thread; and a hardened table disposed at the face end of said cutter body wherein:

said male screw thread is dimensioned so as to mate with said female screw thread;

said circumferential groove of said bore is characterized by a diameter greater than a major diameter of said male screw thread;

said circumferential groove of said cutter body is characterized by a diameter less than a minor diameter of said female screw thread;

said circumferential groove of said bore is characterized by an axial length greater than an axial length of said male screw thread; and said circumferential groove of said cutter body is characterized by an axial length greater than an axial length of said female screw thread.

10. The drilling system of claim 9 further comprising:

at least one radial bearing formed between said bore and said cutter body; and at least one thrust bearing formed between said bore and said cutter body.

11. The drilling system of claim 10 wherein:

said at least one radial bearing is disposed at an axial location from the group consisting of a first location toward the face end of said bore from said female screw thread and a second location toward said root end of said cutter body from said male screw thread; and said at least one thrust bearing is disposed at an axial location selected from the group consisting of said root end of said cutter body and a shoulder formed toward the face end of said bore from said female screw thread.

12. The drilling system of claim 9 further comprising:

a sleeve, said bore being formed in said sleeve; and a pocket formed in said drill bit body, said sleeve being disposed within said pocket such that said bore is provided within said drill bit body.

13. The drilling system of claim 9 further comprising:

a drill string coupled to said drill bit so as to rotate said drill bit within said wellbore.

14. A method for drilling a wellbore in an earthen formation, comprising:

providing a drill bit;

providing a bore in said drill bit, said bore having a generally cylindrical inner surface, a face end facing outwardly from the drill bit, a root end, a female screw thread formed along the inner surface, and a circumferential groove formed along the inner surface between said root end of said bore and said female screw thread;

providing a cutter having a generally cylindrical shaft, a face end, a root end, a male screw thread formed along the shaft, and a circumferential groove formed along the shaft between said face end of the cutter and said male screw thread;

positioning the root end of said cutter into the face end of the bore;

engaging said male screw thread into said female screw thread;

rotatively capturing said cutter within said bore by rotating said cutter in a first direction with respect to said bore so that said male screw thread advances past said female screw thread into said circumferential groove of said bore; and rotating said drill bit within said wellbore, with said cutter engaging said earthen formation to rotate said cutter within said bore in response to the rotation of said drill bit.

15. The method of claim 14, further comprising:

providing a sleeve;

forming said bore in said sleeve;

forming a pocket in said drill bit; and disposing said sleeve within said pocket such that said bore is provided within said drill bit body.

16. The method of claim 14, further comprising:

orienting said bore in said drill bit so that the face end of said cutter defines a rake angle; and urging said cutter to rotate in said first direction within said bore by said rake angle while said drill bit is rotating within said wellbore.

17. The method of claim 14 further comprising:

coupling said drill bit to a drill string; and rotating said drill bit within said wellbore by said drill string.

18. The method of claim 14 further comprising:

retaining by said male screw thread and said female screw thread said cutter within said bore;

providing relief for free relative rotation by said circumferential groove of said bore for said male screw thread; and providing relief for free relative rotation by said circumferential groove of said cutter for said female screw thread.

* * * * *